US008882555B2

(12) United States Patent
Mulligan et al.

(10) Patent No.: US 8,882,555 B2
(45) Date of Patent: Nov. 11, 2014

(54) REMOTE CONTROLLED MOTORIZED RESCUE BUOY

(76) Inventors: Anthony C. Mulligan, Sahuarita, AZ (US); Robert W. Lautrup, Oakton, VA (US)

( * ) Notice: Subject to any disclaimer, the term of this patent is extended or adjusted under 35 U.S.C. 154(b) by 308 days.

(21) Appl. No.: 13/440,782

(22) Filed: Apr. 5, 2012

(65) Prior Publication Data

US 2012/0276794 A1 Nov. 1, 2012

Related U.S. Application Data

(60) Provisional application No. 61/473,077, filed on Apr. 7, 2011.

(51) Int. Cl.

| | |
|---|---|
| ***B63C 9/00*** | (2006.01) |
| ***B63B 35/00*** | (2006.01) |
| ***B63H 11/00*** | (2006.01) |
| ***B63H 21/17*** | (2006.01) |

(52) U.S. Cl.

CPC . *B63C 9/00* (2013.01); *B63H 11/00* (2013.01); *B63H 21/17* (2013.01); *B63B 35/00* (2013.01); *B63B 2035/008* (2013.01); *B63B 2201/08* (2013.01)

USPC ..... 441/80; 440/6; 440/40

(58) Field of Classification Search

CPC ..... B63B 35/00; B63B 2035/006; B63B 2035/007; B63B 2035/008; B63C 9/00; B63C 9/01; B63C 9/02; B63C 9/21; B63H 11/00; B63H 11/107; B63H 11/113

USPC ..... 441/80–89; 114/144 A; 440/6, 38, 40, 440/42; 43/26.1

See application file for complete search history.

(56) References Cited

U.S. PATENT DOCUMENTS

| | | | | |
|---|---|---|---|---|
| 849,887 | A * | 4/1907 | Clark | 441/28 |
| 3,026,545 | A * | 3/1962 | Brainard, II | 114/144 A |
| 4,630,205 | A * | 12/1986 | Otaka | 701/70 |
| 4,753,620 | A * | 6/1988 | Arney | 441/83 |
| 5,492,076 | A | 2/1996 | Kobayashi | |
| 5,597,335 | A * | 1/1997 | Woodland | 441/36 |
| 6,558,218 | B1 * | 5/2003 | Hansen | 441/80 |
| 6,604,480 | B1 * | 8/2003 | Sanchez | 114/150 |
| 8,512,089 | B2 * | 8/2013 | Andersen | 441/42 |
| 2006/0014445 | A1 | 1/2006 | Lawson et al. | |

FOREIGN PATENT DOCUMENTS

| | | | |
|---|---|---|---|
| JP | 06-008879 | A | 1/1994 |
| JP | 11208579 | A | 8/1999 |
| KR | 2019950023162 | U | 8/1995 |
| KR | 1019950043695 | B1 | 8/1999 |
| KR | 200274061 | Y1 | 5/2002 |
| KR | 100339056 | B1 | 6/2002 |
| KR | 200374302 | Y1 | 1/2005 |

OTHER PUBLICATIONS

Human translation of KR 10-0339056, 14 pages.

* cited by examiner

*Primary Examiner* — Ajay Vasudeva
(74) *Attorney, Agent, or Firm* — The Webb Law Firm

(57) ABSTRACT

A remote controlled motorized buoy is provided for rescuing people in the water. The buoy may be controlled by a person with a remote control to navigate to the person in need. The buoy may have flotation mechanisms to keep the buoy right side up in rough water conditions and includes visual indicators to help the user keep track of the buoys location, such as a flag and beacon. When the buoy is near the swimmer, the swimmer may grab the buoy and the buoy may be remotely navigated to bring the swimmer to a safe location.

10 Claims, 7 Drawing Sheets

REMOTE CONTROLLED MOTORIZED RESCUE BUOY

CROSS-REFERENCE TO RELATED APPLICATIONS

This application claims the priority benefit of U.S. provisional application No. 61/473,077, titled "Motorized Rescue Buoy", filed on Apr. 7, 2011, the disclosure of which is incorporated by reference in its entirety.

BACKGROUND OF THE INVENTION

Rescuing swimmers in open water can be a risky operation for rescuers. Swimmers in need of rescue are often desperate and a danger to potential rescuers that come close to the swimmer. Additionally, a swimmer in trouble is often a significant distance away from a potential rescuer, often requiring someone to swim to the troubled swimmer. Because of the time it takes to reach a swimmer and the danger posed to a potential rescuer, there is a need for an improved method for rescuing a swimmer that is in trouble in the water.

SUMMARY OF THE CLAIMED INVENTION

The present technology includes a remote controlled motorized buoy for rescuing people in the water. The buoy may be controlled by a person with a remote control to navigate to the person in need. The buoy may have flotation mechanisms to keep the buoy right side up in rough water conditions and includes visual indicators, such as a flag and beacon, to help the user keep track of the location of the buoy. When the buoy is near the swimmer, the swimmer may grab the buoy and the buoy may be remotely navigated to bring the swimmer to a safe location.

DETAILED DESCRIPTION

Figure 1A:
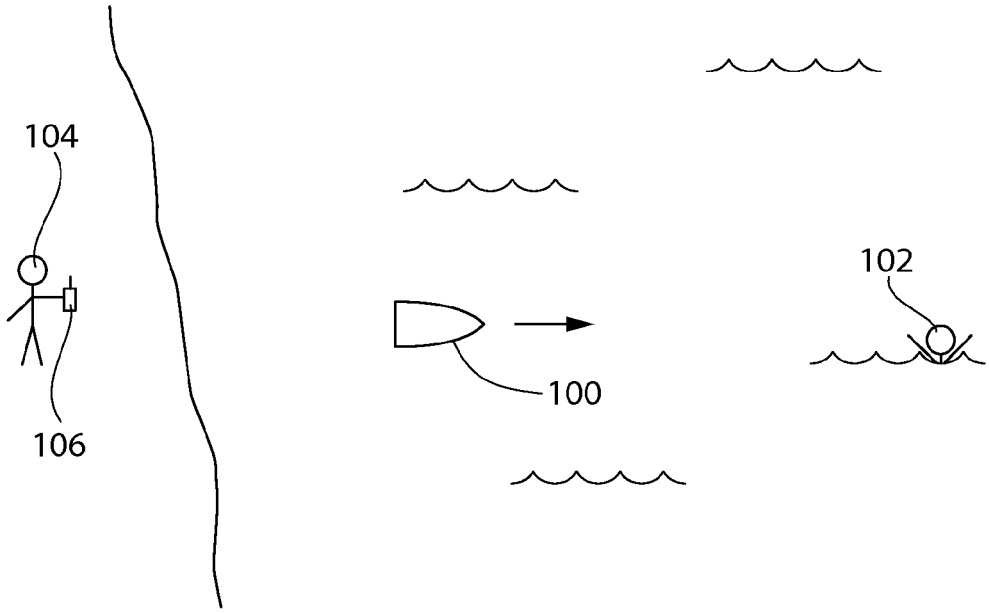
FIG. 1A illustrates a remote controlled motorized rescue buoy approaching a person in water.

The present technology relates to a motorized rescue buoy device for assisting in the rescue of distressed swimmers in beach surf zones and in swift water currents such as floods and rivers. Embodiments of the invention provide fast floatation assistance to a swimmer quicker than typical water rescue personnel can swim out to assist the swimmer in distress, particularly in waters with high currents which can greatly slow the water rescue person or preclude them from reaching the distressed swimmer at all. The remote controlled motorized rescue buoy can travel at high surface planing speeds, for example in excess of 20 miles per hour, is lightweight and easily deployed by a single person. The rescue buoy is lightweight which reduces the chance of un-intended injury to victim in case of collision along with its soft floatation cover, and it has sufficient floatation to provide support to multiple swimmers so they can keep their heads above water. The buoy does not have any exposed propellers to harm swimmers extremities, and has an easy to hold perimeter grab rope covering the circumference of the floatation cover. The buoy may self-right itself in heavy surf conditions, utilizes a jet drive pump so it can slide over sand and rocks with no propeller or rudder to foul on the bottom, and is electrically powered for instantaneous start and it has enough battery power to provide for multiple rescues on single battery.

The advantages of such a fast, robust, easily deployable vehicle are evident. The speed of delivery of lifesaving flotation in a variety of conditions including those that prohibit water entry by rescue personnel is a noted advantage. The small size, light weight, and strong construction allow deployment from significant heights, such as for example from ships, cruise liners, and other vessels, powered or sail, as well as oil and drilling rigs that presently do not have a rapidly deployable equivalent capability. These features gives such a system a significant advantage in response time compared to larger propelled vehicles such as lifeboats and other manned craft, and non-propelled, unmanned devices such as life rings and buoy devices.

It is also noted that few municipalities have ready teams of lifesavers. Rather, it is often a single first responder such as a lifeguard, fireman, sheriff, highway patrolman or EMT who responds initially to a potential drowning victim. Whereas large rescue devices require significant space and may require specialized vehicles to carry them, the motorized buoy of the present technology can easily be carried in common vehicles such as SUVs, small trucks, and sedans. Therefore, it may be readily available for rapid deployment by a first responder, even under conditions that prohibit entry by rescuers into the water.

The present technology is advantageous due to its affordability, reliability and safety through its simple, rugged, electric-powered, jet-pump design. The system is an easily operated system that requires minimal operator training to become proficient and that can be maintained using a minimum of readily available tools and components.

Embodiments may include a digital control system, including an antenna, that is useable in a variety of weather and geographic conditions and at such ranges as may reasonably be required without loss of control. The motorized buoy may have positive buoyancy such that several potential drowning victims will simultaneously be able to remain afloat until rescued. The overall vessel hull is waterproof and that individual systems therein are waterproofed such that, despite a leak in the outer hull, the vessel will continue to operate. In some embodiments, the vessel is to be self-righting and capable of being dropped launch from heights as high as 30 feet, from moving vessels at speeds of 30 knots, and capable of breaching surf with wave heights in excess of 30 feet.

Small, fast, lightweight man-portable vehicles to rapidly deliver flotation to drowning victims have heretofore have not been available. In addition, small model boat size vessels have not been developed to be able to handle harsh physical conditions of breaking ocean surf, or rapid swift water river conditions.

Figure 1B:
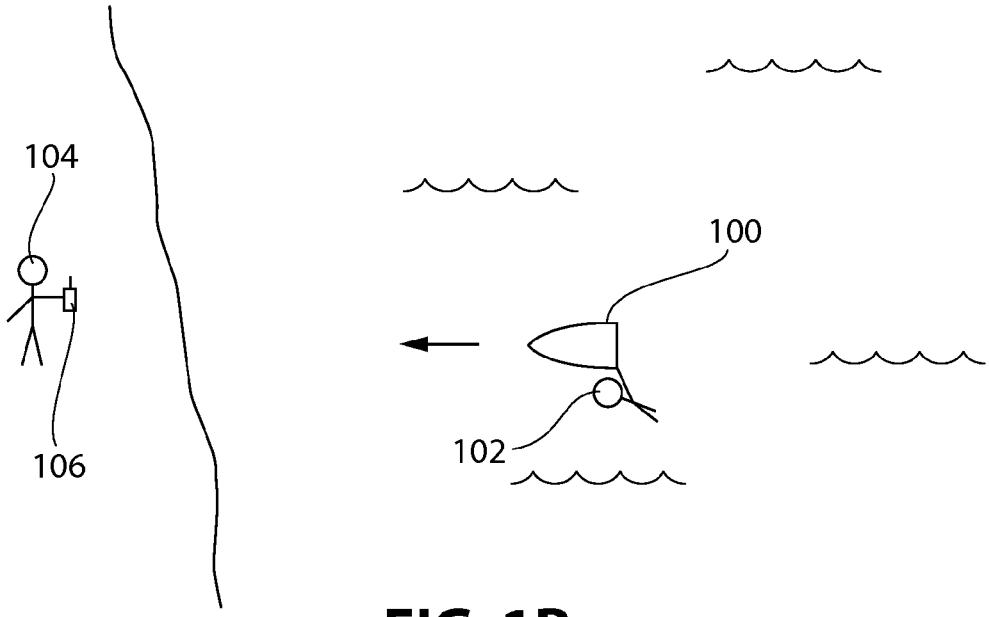
FIG. 1B illustrates a remote controlled motorized rescue buoy bringing a person to safety.

FIG. 1A illustrates a remote controlled motorized rescue buoy approaching a person in water. A user 104 may provide input through remote control 106 to direct remote control motorized rescue buoy 100 towards swimmer 102. User 104 may direct the buoy 100 through waves and around obstacles towards swimmer 102. Once the buoy 100 reaches the swimmer, the swimmer may grab hold of the buoy 100. FIG. 1B illustrates a remote controlled motorized rescue buoy bringing a person to safety. User 104 may use remote control 106 to direct the buoy while the swimmer holds onto the buoy, thereby bringing the swimmer to safety such as a nearby boat, shore, or other location.

Figure 2:
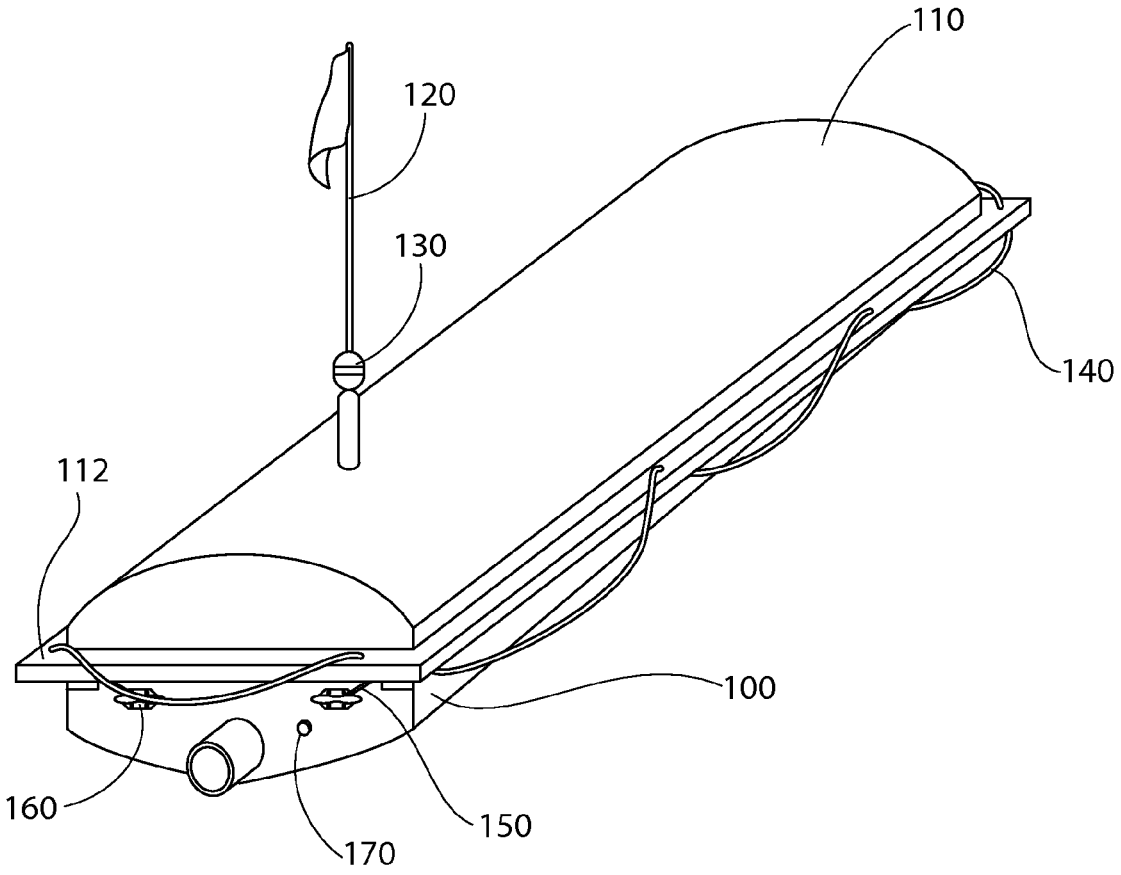
FIG. 2 illustrates a perspective view of an exemplary remote controlled motorized rescue buoy.
Figure 3:
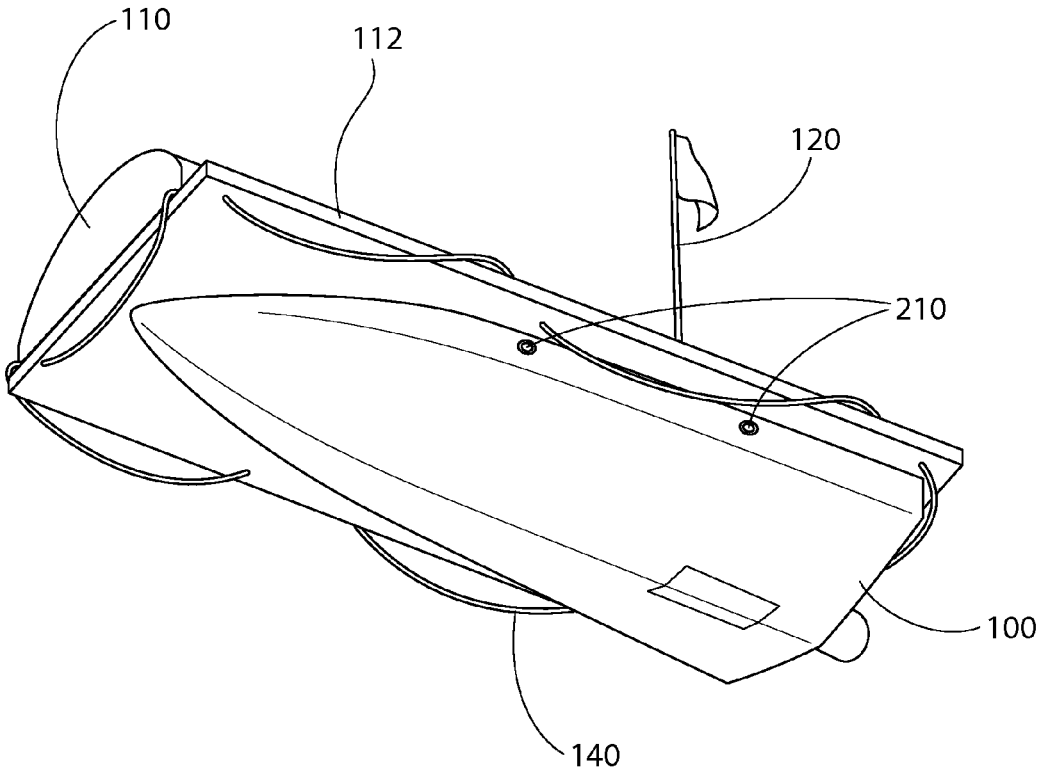
FIG. 3 illustrates another perspective view of an exemplary remote controlled motorized rescue buoy.
Figure 4:
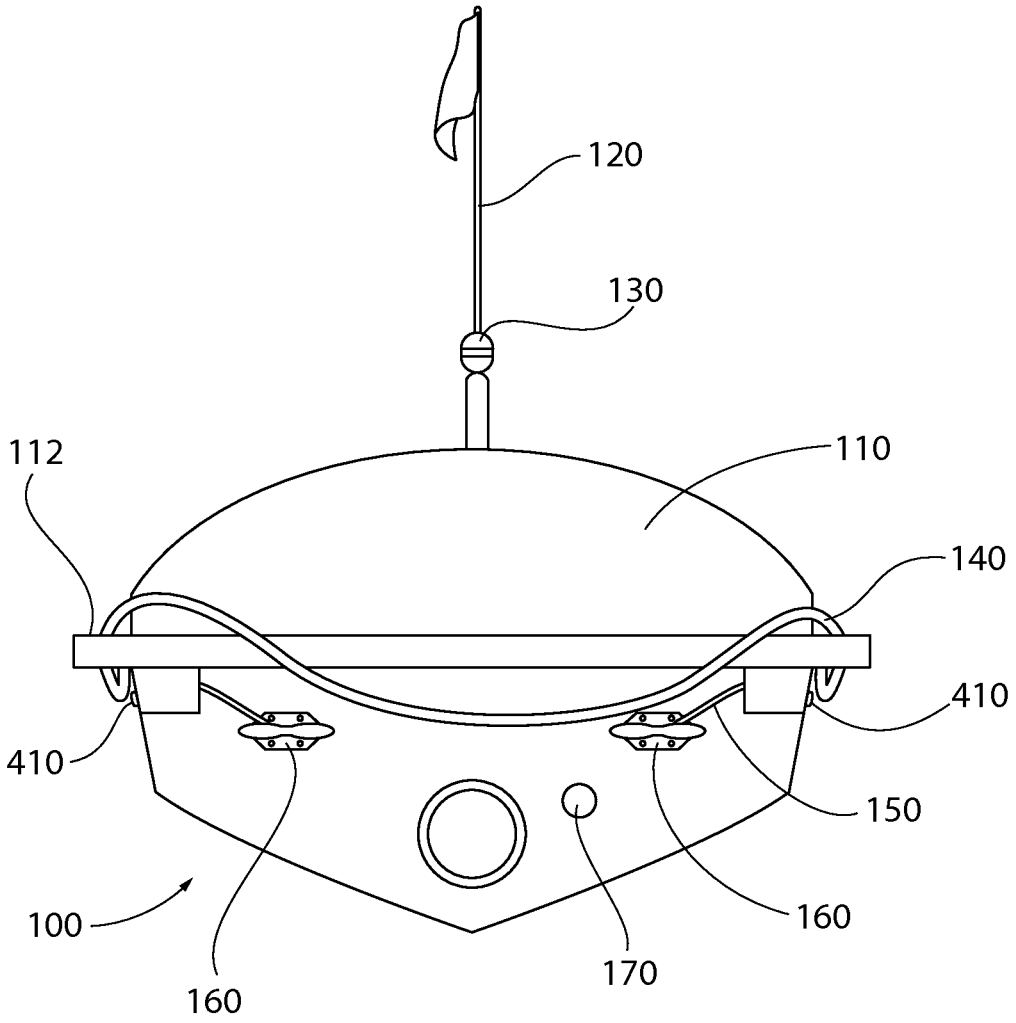
FIG. 4 illustrates a rear view of an exemplary remote controlled motorized rescue buoy.

FIGS. 2 and 3 illustrates a perspective view of an exemplary remote controlled motorized rescue buoy. The buoy of FIG. 2 includes a hull 100. A platform 112 is disposed on an upper surface of the hull 100, and extends to at least an outer periphery of the hull. As seen in FIGS. 2 and 3, the platform has a substantially rectangular shape in a plan view. In some embodiments of the present invention, the platform extends past the outer periphery of the hull. A floatation cover 110, a pole 120, strobe light 130, grab rope 140, draw string 150, cleats 160, and a power switch 170. Hull 100 may encase the motor and other parts of the motorized buoy. In some embodiments, hull may be a composite hull with dimensions of about 50 inches in length and 14 inches across the beam. Floatation cover 110 may be affixed to the top of the hull 100. Pole 120 may extend from the top of hull 100 and include a strobe light 130. The strobe light may be a light or any other device that provides a visual indicator to a user remotely controlling the motorized buoy. Grab rope 140 may be used by a swimmer to hold onto the buoy device as the device is being controllably navigated to safety. The grab robe 140 may be affixed to either the canvas flotation cover 110, the hull 100, or some other portion of the buoy. The grab rope may extend around the perimeter of the buoy or a portion of the perimeter. The floatation cover 110 may include a draw string 150 and cleats 160 mounted on a portion of the hull platform 100. The cleats may be used to secure the floatation cover 110 along with male counterpart snaps 210 (FIG. 3) mounted on hull 100 along its midsection. The cleats and snaps may hold the floatation cover 110 firmly secured to hull 100. An externally mounted main power on/off switch 170 is mounted on the transom of the vessel for easy access by the operator. FIG. 4 illustrates a bottom view of an exemplary remote controlled motorized rescue buoy. Quick connect snaps 410, commonly used in the pleasure craft boating industry, as illustrated in FIG. 4 may also be used to attach the flotation cover 110 to hull 100.

In some embodiments, floatation cover 110 is formed from canvas. In other embodiments, floatation cover 110 may be constructed of a lightweight foam material that can be either open cell or closed cell with a durable marine grade canvas cover or polyurethane material. The floatation cover 110 is designed to fit on to the vessel similar to the way a standard boat cover fits on a full size manned boat. It utilizes a draw string 150 that circumscribes the perimeter of the floatation cover 110 with one end attached to a transom mounted tie down cleat 160, then the draw string 150 is pulled tight to secure the cover on the deck of the hull 100. Standard marine canvas snap clips 210 secure the sides of the floatation cover 110 to the hull 100. These snap clips 210 assist in aligning the floatation cover 110 during installation and they provide added holding retention of the floatation cover 110 to hull 100 during breaching of large surf waves. The pole 120 should be designed to be 4-5 feet in height and is used for visual location of the rescue buoy when operating in wave with heights greater than 2-3 feet. The strobe beacon 130 also aids in locating the rescue buoy when operating in rain, heavy mist, or fog.

Figure 5:
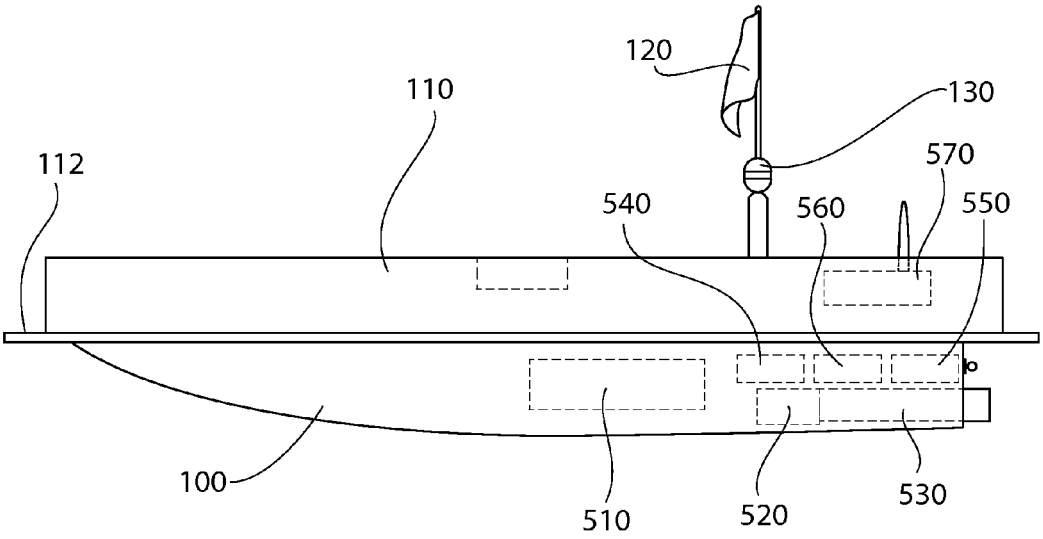
FIG. 5 a side view of an exemplary remote controlled motorized rescue buoy.

FIG. 5 a side view of an exemplary remote controlled motorized rescue buoy with an internal control and power system subsystem. The buoy of FIG. 5 includes battery 510, motor 520, jet pump 530, speed controller 540, radio control 550, safety switch 560, and radio 570. In some embodiments, each component and subsystem may be mounted in a water proof casing. The vessel hull 100 is designed such that it is water tight using techniques standard to the art of boat making. In addition, each of the subsystem components are housed in a watertight container casing with water proof electrical connectors as commonly used by those trained in the art. This allows the vessels subsystems to operate even if the hull platform chamber is breached and flooded so an emergency rescue mission can be completed.

Motor 520 may utilize electrical power for propulsion, due to its long storage, safety, and quick starting characteristics. In some embodiments, an internal combustion engine or other engine may also be used for power. The electric motor 12 should have a rated power range from 375 watts to 2500 watts.

Battery 510 may include a lithium polymer rechargeable battery pack with an energy capacity in the range of 70 watt hours to 2,000 watt hours. The battery may be contained within a waterproof battery casing. The lithium polymer battery system may be replaced with other systems such as alkaline, nickel cadium, metal hydride, or lead acid batteries. The battery within the casing is wired to an electronic safety switch 560. The switch 560 is contained in a separate water proof case and remotely controlled with the mounted on/off switch 170. The electronic safety switch 560 is wired to the electronic speed controller 540, electric motor 520 and radio control 550. The remote controller device 15 should be mounted in a water proof casing.

The electronic speed controller 540 should have a matching power rating to the electric motor 520 but it should also have a continuous current capacity of at least 200 amps. The electric motor 520 and electronic speed controller 540 should be designed with a metal heat sink casing with additional water cooling as understood by those trained in the art. The metal heat sink cooling should be of large enough heat capacity thermal mass to allow the system to operate for one multi-minute rescue mission incase of water cooling failure.

The electric motor 520 directly drives a jet drive pump 530 with impeller size in the range of 30-60 millimeters in diameter. The preferred embodiment is for the jet drive 530 to use an airfoil shaped stator blade assembly to straighten out flow with a steerable exit nozzle mounted on the out end of the jet drive pump 530. The inlet section of the pump 530 should have a grating that prevents a swimmers fingers or toes from being sucked into the pump and harmed by the impeller. The grating should be constructed of strong, corrosion resistant metal and should be readily replaceable incase of damage by rocks, seaweed or other debris in the water. Due to the expected propensity of low maintenance of this system by operators, the pump should utilize long lasting ceramic bearing journals and non salt water corrosive materials such as composite polymers or stainless steel.

Figure 6:
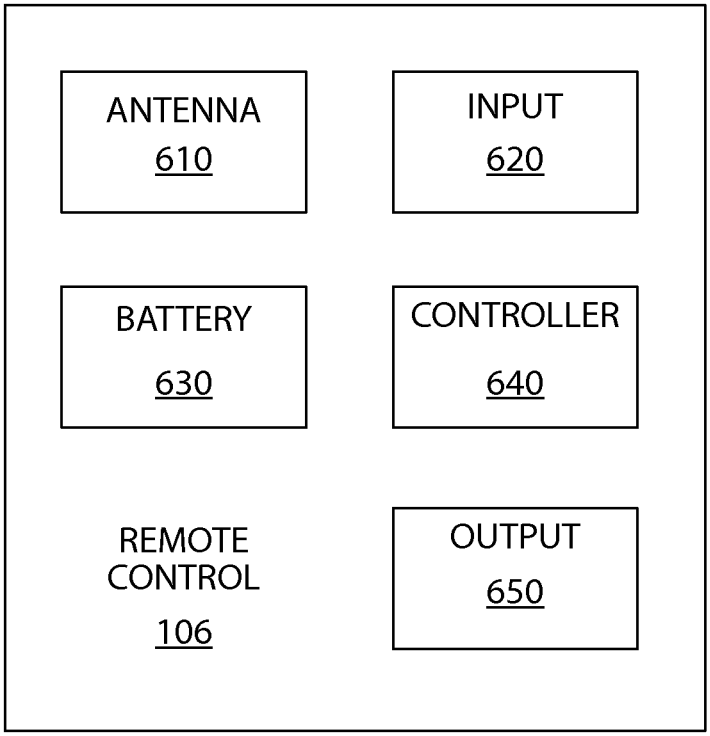
FIG. 6 is a block diagram of an exemplary remote control.

FIG. 6 is a block diagram of an exemplary remote control device. The remote control 106 of FIG. 6 includes an antenna 610, input 620, battery 630 and controller 640. A user may provide input via input 620. The input may power the remote control motorized rescue buoy on or off, adjust a level of thrust from stop to full acceleration, adjust the direction of thrust to forward or reverse, and adjust a rudder, jet propulsion direction, or other mechanism to steer the buoy through water.

Controller 640 may receive input signals from input 620, convert the signals to commands in radio frequency format, and transmit the commands via antenna 610. Antenna 610 may send and receive signals via a radio frequency with the remote control motorized rescue buoy. Information received from the buoy may be provided to a user of the remote control 106 via output 650. For example, the buoy may indicate a power level in a battery, a temperature within the motor or hull, a signal indicating a user has grabbed a grab rope 140 (ie, via a tension detection mechanism on the buoy, not illustrated), or some other signal from the buoy. The output may include visual, audio, or other output. Battery 630 may provide power to the components of remote control 106 that require power to operate.

Figure 7:
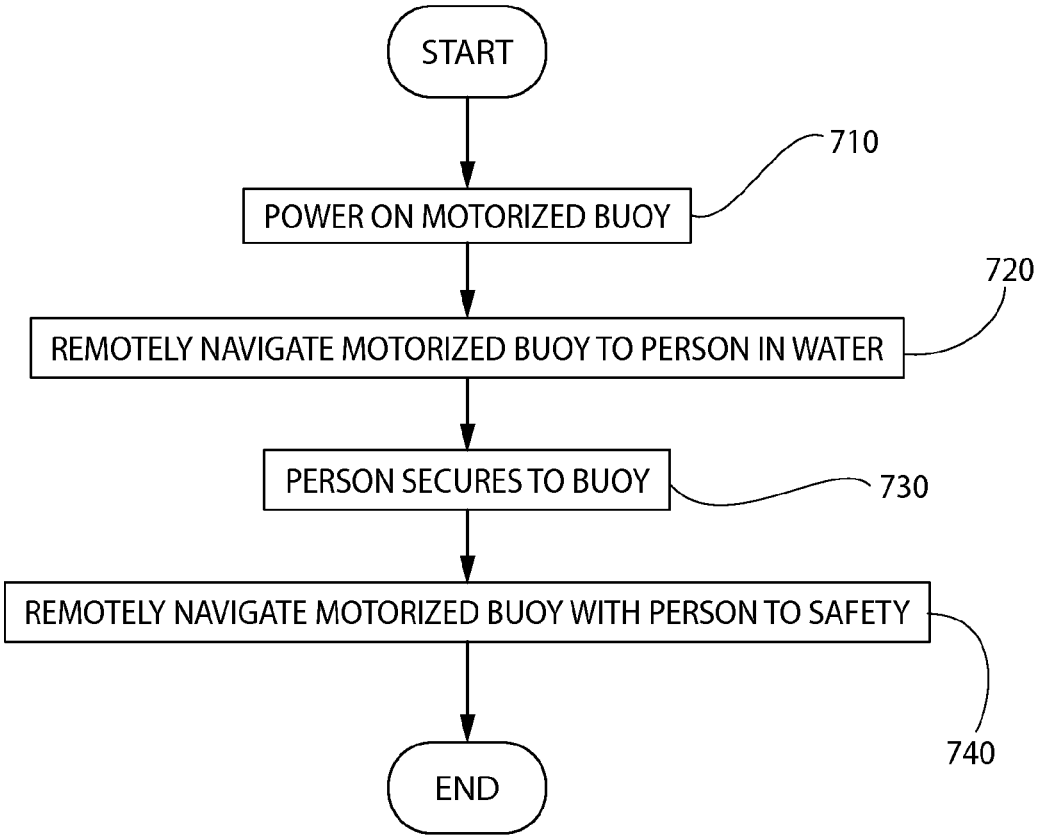
FIG. 7 is an exemplary method of operating a remote controlled motorized rescue buoy.

FIG. 7 is an exemplary method of operating a remote controlled motorized rescue buoy. The remote controlled motorized rescue buoy 100 is powered on at step 710. The buoy may be powered on remotely (hence, it may be in a standby mode initially) or manually by pressing power switch 170.

The buoy 100 may by remotely controlled to navigate towards a person in water at step 720. A user 104 may provide input into remote controller 106 to navigate the buoy towards the person. A person secures to the buoy at step 730. The person may secure to the buoy by grabbing a portion of the buoy system, such as grab rope 140. In some embodiments, a tension sensor may indicate that the person has secured the grab rope and send a signal back to remote controller 104.

The motorized buoy 100 may be remotely controlled to navigate to safety at step 740. To remotely navigate the buoy, a user may provide input at the remote control to navigate the buoy to a beach, boat or other location where the swimmer may be safe.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. A remotely controlled motorized rescue buoy comprising:

a buoyant self-righting rigid hull having a v-shaped bottom;

a substantially rectangular platform disposed on an upper surface of the hull, the rectangular platform extending beyond an entire outer periphery of the hull;

a jet pump propulsion unit disposed in a watertight compartment in the hull, the jet pump propulsion unit having a steerable jet nozzle communicating with a rear-facing wall of the hull;

a motor disposed in a watertight compartment in the hull and coupled to the jet pump propulsion unit;

a radio receiver configured to wirelessly receive operating signals from a remote-control transmitter;

a control unit disposed in a watertight compartment in the hull and coupled to the radio receiver, the jet pump propulsion unit, and the motor and configured to control the speed of the motor and the steerable exit nozzle of the jet pump propulsion unit in response to the operating signals received by the radio receiver from the remote-control transmitter;

a power switch to control the motor, the radio receiver, and the jet pump propulsion unit, the power switch disposed on the outside of the hull;

a floatation cover detachably secured to the platform and completely enclosing an outer perimeter of the platform; and at least one grab line disposed around the platform, the grab line configured to allow a person floating in water to grab and hold onto the rescue buoy, wherein the rescue buoy is configured to be remotely navigable to support and bring a distressed swimmer to a safe location.

2. The motorized rescue buoy of claim 1, further including a beacon for providing a visual signal.

3. The motorized rescue buoy of claim 1, further including a pole extending vertically from the buoy with a visual indicator.

4. The motorized rescue buoy of claim 3, wherein the visual indicator is a flag.

5. The motorized rescue buoy of claim 1, wherein the at least one grab line includes a rope.

6. The motorized rescue buoy of claim 1, wherein the radio receiver receives control signals for navigating the buoy.

7. The motorized rescue buoy of claim 1, wherein the buoy is configured to be launched by dropping the buoy from a height of at least 20 feet.

8. The motorized rescue buoy of claim 1, wherein the motor is an electric motor.

9. The motorized rescue buoy of claim 1, wherein the motor is an internal combustion engine.

10. The motorized rescue buoy of claim 1 having a weight and form factor making it deployable by a single person.

* * * * *